US006112821A

United States Patent [19]

Yokoi

[11] Patent Number: 6,112,821

[45] Date of Patent: Sep. 5, 2000

[54] SPRINKLER HEAD

[75] Inventor: Shin Yokoi, Osaka-fu, Japan

[73] Assignee: Yokoi Incorporated, Osaka, Japan

[21] Appl. No.: 09/402,176

[22] PCT Filed: Jan. 28, 1999

[86] PCT No.: PCT/JP99/00375

§ 371 Date: Sep. 30, 1999

§ 102(e) Date: Sep. 30, 1999

[87] PCT Pub. No.: WO99/39774

PCT Pub. Date: Aug. 12, 1999

[30] Foreign Application Priority Data

Feb. 4, 1998 [JP] Japan ..... 10-023341

[51] Int. Cl.[7] ..... A62C 37/08

[52] U.S. Cl. ..... 169/41; 169/37

[58] Field of Search ..... 169/37–41

[56] References Cited

U.S. PATENT DOCUMENTS

| | | | |
|---|---|---|---|
| 4,660,648 | 4/1987 | Zen | 169/37 |
| 5,159,984 | 11/1992 | Hattori | 169/38 |
| 5,373,989 | 12/1994 | Hattori | 169/37 |
| 5,497,834 | 3/1996 | Onuki | 169/37 |
| 5,829,532 | 11/1998 | Meyer et al. | 169/37 |
| 6,044,912 | 4/2000 | Tsuji et al. | 169/37 |

*Primary Examiner*—Andres Kashnikow
*Assistant Examiner*—Dinh Q. Nguyen
*Attorney, Agent, or Firm*—Griffin & Szipl, P.C.

[57] ABSTRACT

A new sprinkler head for sprinkler installations is claimed which is compact and reduces production costs. In addition, the structure makes possible installation to a distribution pipe ahead of fitting a ceiling and easily enables checks for leakage. In detail a main body has an upper body connected to a water distribution pipe in a ceiling, the main body has an upper body with a valve seat which has a shoulder situated at the lower end of the upper body, and a lower frame which has a plurality of lugs facing inward. A nozzle has a plurality of discharge apertures at its lower end and an outwardly flared nozzle retainer which moves freely up and down inside the upper body and prevents movement of the nozzle passed the shoulder. A cap has a seal which seals the valve seat outside of the upper body at the bottom of the nozzle. A holder is supported by connection to lugs of the lower frame, once water under pressure from the top engages the inclined surface or using the elasticity of a coil spring the holder turns to separate it from the lugs and it drops off, a glass bulb is situated vertically between the cap and the holder, the cap can be moved towards the valve seat by turning a pressure screw.

10 Claims, 8 Drawing Sheets

SPRINKLER HEAD

TECHNICAL FIELD

The present invention relates to an improved sprinkler head for use in sprinkler installations suitable for use in, for example, the ceilings of theatres, department stores, schools, hospitals, factories and storage buildings. The sprinkler head of the invention can be connected easily to a distribution pipe prior to constructing a ceiling; its structure is extremely simple and it has few parts requiring assembly, the size is also reduced and production costs are low.

TECHNICAL BACKGROUND

FIGS. 14, 15 and 16 show conventional sprinkler heads.

The sprinkler head shown in FIG. 14 comprises a heart-shape body arm 20, a deflector 21, a valve plug 22, a fluid passage 20*a* and a glass bulb 23. In use when the glass bulb 23 is shattered by heat the valve plug 22 drops down, and water is ejected from the fluid passage 20*a* of the body arm 20 to hit the deflector 21 so that water sprinkles in to the desired area.

The sprinkler head shown in FIG. 15 comprises a shaped frame 24, a deflector 25, a valve plug 26, a thermal release element 27, a housing 28, an escutcheon 29 and a cover plate 30. As the temperature around the sprinkler head increases the escutcheon 29 and cover plate 30 drop down to expose the body arm 24 and deflector 25. When the thermal release element 27 has melted, the thermal release element 27 and valve plug 26 drop down, water is ejected and deflected by the deflector 25 into the desired area.

The sprinkler head in FIG. 16 comprises a body 31, a valve plug 32, a deflector guide 33, a deflector 34, a fusible pellet (not shown) and an escutcheon 35. If the pellet is melted by heat, the valve plug 32, deflector guide 33 and deflector 34 drop down a limited distance and water is ejected from the fluid passage 31*a* of the body 31 to hit the deflector 34 which deflects water into the desired area.

If the sprinkler head shown in FIG. 14 is connected to the distribution pipe (not shown) prior to constructing the ceiling, the heart-shaped body arm 20 obstructs fitting of the ceiling board. Conversely if the sprinkler head is fitted after the ceiling is completed it is difficult to check for any leakages. If the ceiling is to be constructed before the sprinkler head is fitted, large gaps are made in the ceiling to accommodate them when subsequently fitted; however, this is not satisfactory from an aesthetic point of view.

The sprinkler head shown in FIG. 15 could be fitted to a distribution pipe prior to constructing a ceiling; however, it is poorly designed, firstly because of the space 36*a* in the ceiling 36 which is required to put the body arm 24 into the housing 28 and then the housing 28 is covered by the cover plate 30. In addition, there is a problem with water distribution from the deflector 25 because there is insufficient space between the deflector 25 and the ceiling 36*b*.

The sprinkler head shown in FIG. 16 may also be fitted to a distribution pipe prior to constructing the ceiling. However, there are difficulties in controlling the fusible pellet and the head is expensive. It also has poor design by showing the deflector 35 and the fins 37 exposed.

DESCRIPTION OF THE INVENTION

The present invention seeks to provide a sprinkler head in which the above-mentioned disadvantages of previously known sprinkler heads are overcome and which provides the following benefits:

a) the sprinkler head may be connected to a distribution pipe prior to constructing a ceiling;

b) the sprinkler head is attractive and has a smart design;

c) there are few parts and the design is simple;

d) low cost.

The new sprinkler head was invented to resolve the problems with the following embodiments. The invention as claimed in Claim 1 comprises a cylindrically curved upper body 1*a* which connects to a distribution pipe (not shown) at ceiling level. Extending from the upper body 1*a* is a lower frame 1*b* and a valve seat 1*d* with a shoulder 1*e* at the bottom end of inner upper body 1*a*. The body 1 has several lugs 1*g* inside the lower body 1*b* to retain the holder 4. A nozzle 2 has a plurality of discharge apertures 2*a* at its lower end and an outwardly flared retainer portion 2*b* at its upper end which limits downward movement of the nozzle 2 by increasing the width of the nozzle at this end so as to prevent movement of the nozzle 2 past the shoulder 1*e*. A cap 3 is attached to the nozzle 2 and has a seal 3*e* which is adjacent to the valve seat 1*d* of the upper body 1*a* when the sprinkler head is not in operation. A holder 4 is held in place by a lug 1*g* situated on the lower body 1*b* and has an inclined surface 4*f* against which water under pressure from the top engages, which cause the holder to turn to separate it from the lugs 1*g* and drop. A glass bulb 5 is situated vertically between the cap 3 and holder 4, the cap 3 can be moved towards valve seat 1*d* by turning an adjustment screw 6. These are the basic structures of this invention.

Claim 2 of the invention refers to a body as described in Claim 1 in which the upper body 1*a* and a lower frame 1*b* are separate components.

Claim 3 of the invention refers to the lower frame 1*b* described in Claims 1 and 2, which has three arms 1*f*.

Claim 4 of this invention refers to the cap 3 as described in Claim 1 which has an upper collar 3*c* on a main base 3*a* on which the seal 3*e* is situated.

Claim 5 of this invention refers to the holder 4 as claimed in Claim 1 which comprises an upper ring 4*a*, a lower ring 4*b* and a connector arms 4*c* which connect the upper ring 4*a* to the lower ring 4*b*. At the top of upper ring 4*a* are three drive blocks 4*d* each with a convex surface 4*e* and an inclined surface 4*f*.

The invention as claimed in Claim 6 comprises an upper body 1*a* connected to a distribution pipe at ceiling level and a valve seat 1*d* which is situated at the lower end of the upper body 1*a*. The body 1 comprises an upper body 1*a* containing a valve seat 1*d* which has a shoulder 1*e* and a lower frame 1*b* which has several lugs 1*g* facing inward. A nozzle 2 has several discharge apertures 2*a* and a nozzle retainer 2*b* which moves freely up and down inside the upper body 1*a* to control the downward movement of the nozzle 2 by connecting to the shoulder 1*e*.

The cap 3 has a seal 3*e* which seals the valve seat 1*d* outside the upper body 1*a* which locates the bottom of the nozzle 2. The holder 4 is supported by connection to the lugs 1*g* of the lower frame 1*b* has a pressure screw 6 at the center of the bottom, and when turned releases the holder from holding step 1*g* allowing it to drop off. A glass bulb 5 is situated vertically between the cap 3 and holder 4 and applies pressure to the cap 3 upward towards the valve seat 1*d* adjusted by pressing screw 6. A coil spring 9 wraps around the glass bulb 5 and connects at one end to the body 1 and at the other end to the holder 4 to apply a turning force to separate the holder 4 from the holding step 1*g*. When the glass bulb 5 bursts the coil spring 9 turns the holder 4 so that it drops off.

Claim 7 of this invention is a body which consist of an upper body 1*a* and a lower frame 1*b* as described in Claim 6.

Claim 8 of this invention is a lower frame which has three arms 1*f* at a lower part of the lower frame 1*b* as described in Claims 6 and 7.

Claim 9 of this invention is the cap 3 as described in Claim 6 which has an upper collar 3*c* outside the main base 3*a* and a seal 3*e* attached to the upper collar 3*c*.

Claim 10 of this invention refers to the holder 4 in Claim 6 which has an upper ring 4*a*, a lower ring 4*b* and a coupling bar 4*c*, and has a convex surface 4*e* at the top of the upper ring 4*a*.

DESCRIPTION OF SYMBOLS

1—Body
1*a*—Upper Body
1*b*—Lower Frame
1*c*—Fluid Passage
1*d*—Valve Seat
1*e*—Shoulder
1*f*—Arms
1*g*—Lug
2—Nozzle
2*a*—Discharge Aperture
2*b*—Nozzle Holder
3—Cap
3*a*—Main Base
3*b*—Glass Bulb Holding Space
3*c*—Upper Collar
3*d*—Lower Collar
3*e*—Seal
4—Holder
4*a*—Upper Ring
4*b*—Lower Ring
4*c*—Connector Arm
4*d*—Drive Block
4*e*—Convex Surface
4*f*—Inclined Surface
4*g*—Screw Hole
5—Glass Bulb
6—Pressure Screw
7—Cover
8—Ceiling
9—Coil Spring A preferred embodiment of the new sprinkler head is described in the following description with reference to the accompanying drawings.

Figure 1:
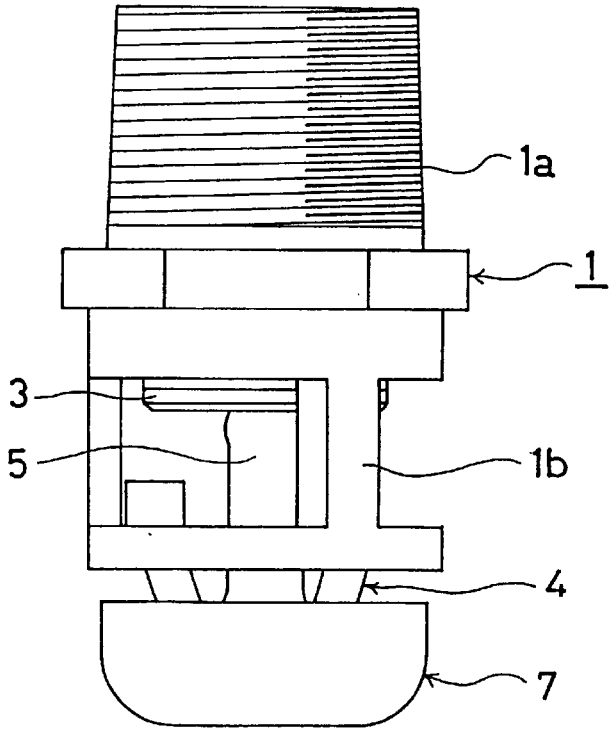
FIG. 1 is a side view of a sprinkler head of the first embodiment.
Figure 2:
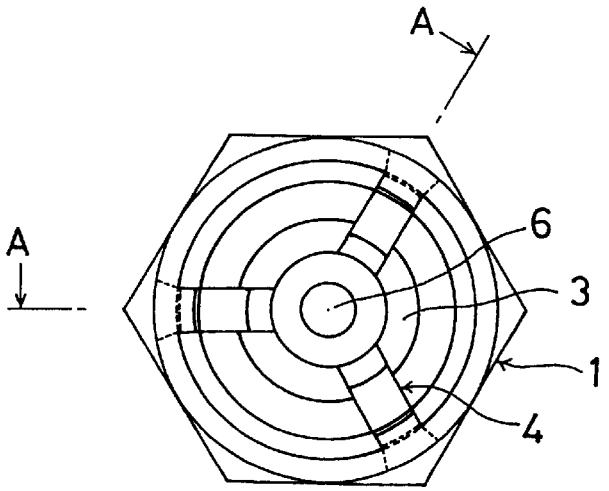
FIG. 2 is an underplan view of the sprinkler head shown in FIG. 1.
Figure 3:
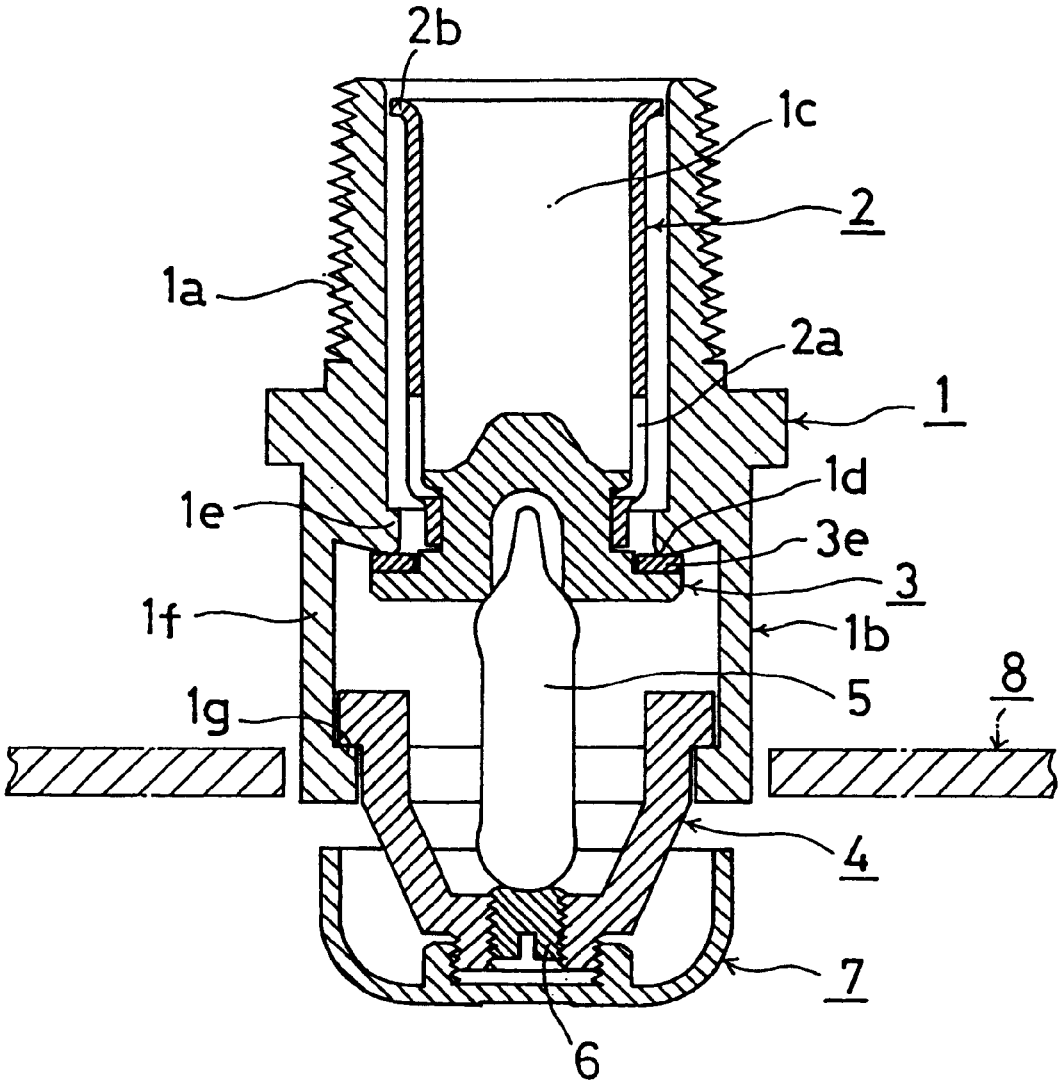
FIG. 3 is a schematic sectional view of a sprinkler taken on the line A—A in FIG. 2.
Figure 4:
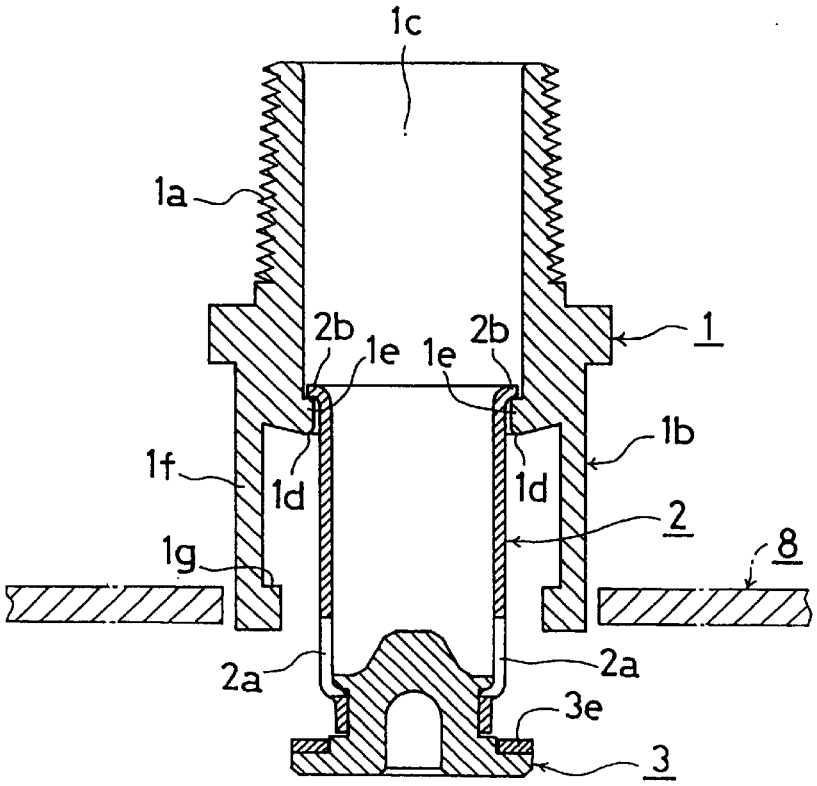
FIG. 4 is a schematic drawing of the same sprinkler as shown in FIG. 3 when the sprinkler head is deployed.

FIG. 1 is a side view of a sprinkler head of the first embodiment and FIG. 2 is an underplan view of the sprinkler head of FIG. 1 with the cover 7 removed. FIG. 3 is a section taken along the line A—A of FIG. 2, and FIG. 4 shows the same sectional view as FIG. 2 taken along line A—A of a deployed sprinkler head. Referring first to FIGS. 1 and 4, there is shown a sprinkler head comprising a body 1, a nozzle 2, a cap 3, a holder 4, a glass bulb 5 and a pressure screw 6. When the temperature is raised by a fire, the glass bulb 5 bursts and the nozzle 2 drops which allows pressurised water to flow through body 1 to turn holder 4, which releases the holder 4 from the body 1. Consequently, the discharge apertures 2*a* of the nozzle 2 are located just under the ceiling 8 level and spread water radially.

Figure 5:
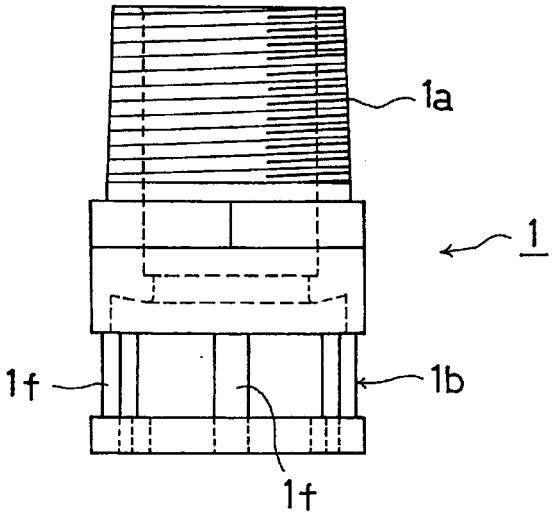
FIG. 5 is a schematic drawing of the body.
Figure 6:
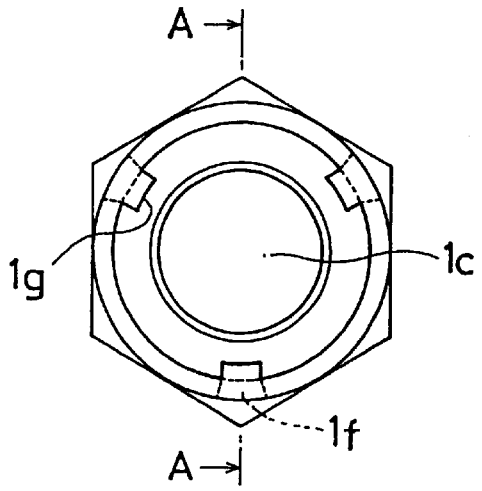
FIG. 6 is an underplan view of the body shown in FIG. 5.
Figure 7:
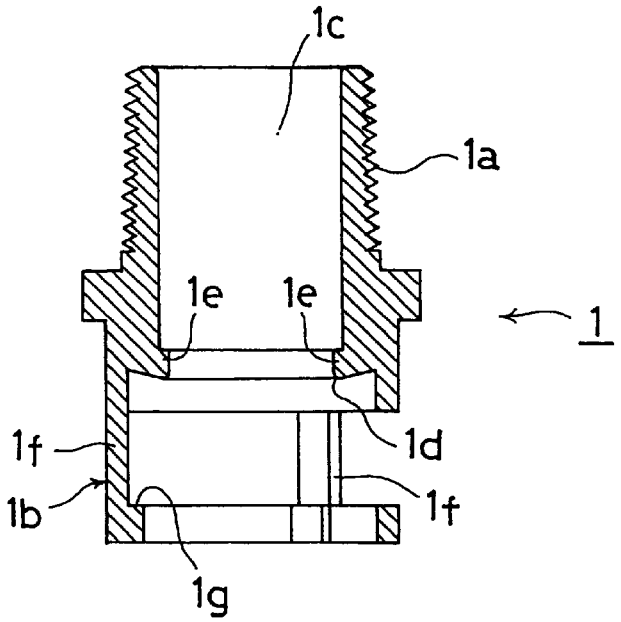
FIG. 7 is a sectional view of the body shown in FIG. 6 taken on the line A—A.

As mentioned above the body 1 may be vertically connected to a distribution pipe (not shown) through a branch pipe, which may be a flexible pipe, and comprises an upper body 1*a* which connects to the distribution pipe and a lower frame 1*b* just below the upper body 1*a*. The upper body 1*a* is shown in FIGS. 5 and 7 with a vertical fluid passage 1*c* at its centre, inside of the upper body 1*a* there is an annular shoulder 1*e* with a valve seat 1*d* at its underside. Lower body 1*b* has three arms 1*f* by which it is connected to the above-mentioned upper body 1*a*. A lug 1*g* projects from each arm 1*f* of the lower frame 1*b* and holds the holder 4 which is described later in this document.

In this embodiment, the lower body 1*b* has three arms 1*f* which can may alternatively be modified to four legs, which may be in the form of pipes having holes to allow air to pass through easily. Also in this embodiment, the lower body 1*b* is integrally formed with the upper body 1*a* as one unit; however, it is possible to produce an upper body 1*a* and a lower body 1*b* as separate parts and connect the two parts together with a screw.

The nozzle 2 as shown in FIG. 3, has a smaller in diameter than the fluid passage 1*c* and is open at both ends and, when inserted into the fluid passage 1*c*, is free to move up and down. The upper rim of the nozzle 2 has been flared outwards to create nozzle retainer 2*b*. The bottom of nozzle 2 can be reduced slightly to a smaller diameter to produce a tight connection between the cap 3 and the nozzle 2.

When the glass bulb 5 shatters the nozzle 2 drops down until the nozzle retainer 2*b* (which will be described in more detail later) is in contact with the top of shoulder 1*e* in the body 1 which limits the downward movement and maintains the nozzle 2 in a vertical position as shown in FIG. 4. In this embodiment, the nozzle holder 2*b* is created by flaring the top of nozzle 2 outward; however, it is also possible to attach a nozzle retainer 2*b* to the outside of the nozzle 2.

The nozzle 2 has a plurality of discharge apertures 2*d* at its lower end and when the sprinkler head is deployed the nozzle 2 moves down and the nozzle retainer 2*b* contacts the shoulder 1*e* of body 1, each discharge aperture 2*a* is then below the ceiling 8 and water ejects radially.

Figure 8:
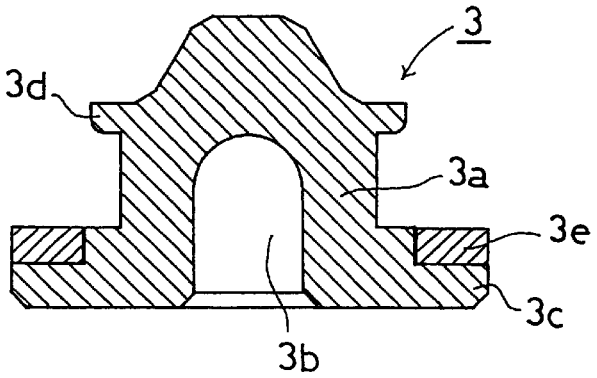
FIG. 8 is a sectional view of the cap.
Figure 9:
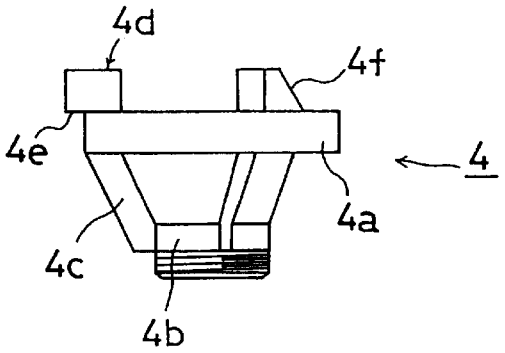
FIG. 9 is a side view of the holder.

The cap 3 as shown in FIG. 8 comprises a short columnar main base 3*a*, a glass bulb holding space 3*b* at the centre of the main base 3*a*, a lower collar 3*c* at main base 3*a*, and an upper collar 3*d* which is located at the top of main base 3*a*. The nozzle and cap are joined by inserting the head of the main base 3*a* into the nozzle 2 from below and reducing the diameter of the nozzle 2 to create tight connection.

At the top of the upper collar 3*c* of the cap 3 a disc-shape seal 3*e* is fitted as shown in FIGS. 3 and 4. By pressing the seal 3*a* against the valve seat 1*d* of the body 1 this produces a fluid tight seal in the passage 1*c* of the body 1 preventing escape of water from the pipe (not shown). A hermetically sealed liquid (for example alcohol) is contained in the glass bulb 5 and the glass bulb 5 is positioned between the cap 3 and the holder 4, which will be described later, as shown in FIG. 3. The glass bursts when the surrounding temperature increases.

Figure 12:
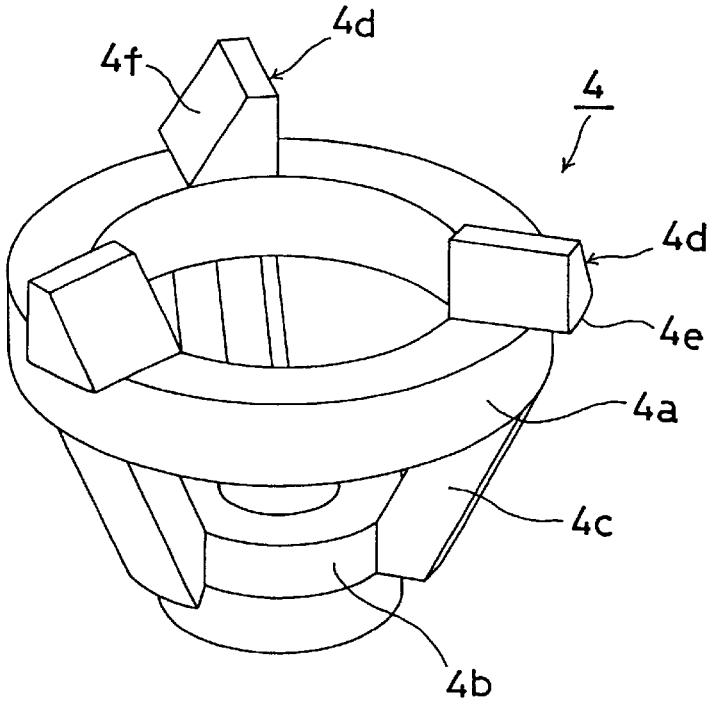
FIG. 12 is a perspective view of the holder.

The holder 4 as shown in FIGS. 9 to 12 comprises a larger diameter upper ring 4*a* and a smaller diameter lower ring 4*b*, three connector arms 4*c* which connect to both upper ring 4*a* and lower ring 4*b* and three trapezoidal drive blocks 4*d* located on the upper ring 4*a*. The drive blocks 4*d* project out from the side of the upper ring 4*a*, and have a bottom wall with a convex surface 4*e* to engage the upper surface of lugs 1*g* of the lower frame 1*b* to retain the holder 4 on the body 1. Each drive block 4*d*, as shown in FIG. 12, has an inclined surface 4*f* and the water flow W applies pressure vertically to each inclined surface 4*f* and consequently the reaction force F acts to turn the holder 4 in the marked direction T which moves the drive blocks 4*d* away from the lugs 1*g* allowing the holder to fall away from the body 1.

Figure 10:
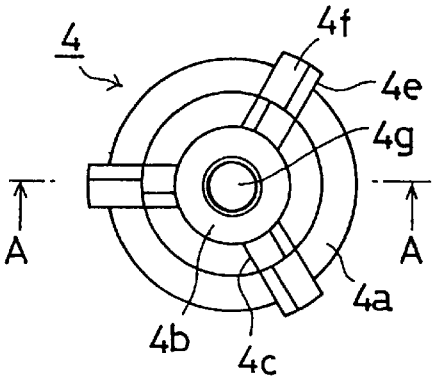
FIG. 10 is an underplan view of the holder shown in FIG. 9.
Figure 11:
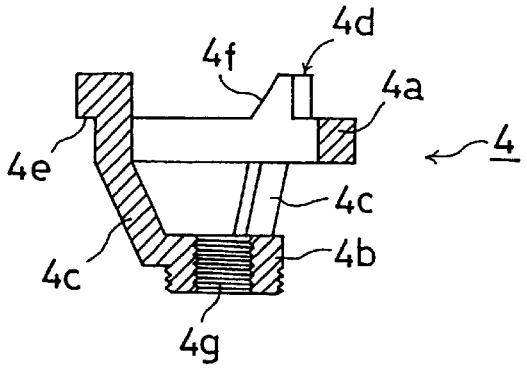
FIG. 11 is a sectional view of the holder shown in FIG. 10 taken on the line A—A.

There is a screw hole 4*g* at the centre of lower ring 4*b* as shown in FIG. 10. The glass bulb 5 is located between the cap 3 and the holder 4 with appropriate pressure applied by inserting a pressure screw 6 into the screw hole 4*g*. The holder 4 in FIG. 12 has three connector arms 4*c* although the construction is not restricted to this type only but also is applicable to construction with more than four connector arms or possibly a holder 4 having holes in to allow air to pass through easily. In this embodiment the drive 4*d* with convex surface 4*e* and inclined surface 4*f* is situated at the upper part of the upper ring 4*a* of the holder 4. However, in other embodiments (not shown) they can be separated into two as a holder 4 comprising a convex surface 4*e* to connect to the holding step 1*g* of body 1 and an inclined surface 4*f* to turn the holder 4.

A cover 7 may cover the holder 4 and is easy to attach to the lower ring 4*b* of the holder 4. When the cover 7 is attached it blends in with the ceiling 8.

Figure 13:
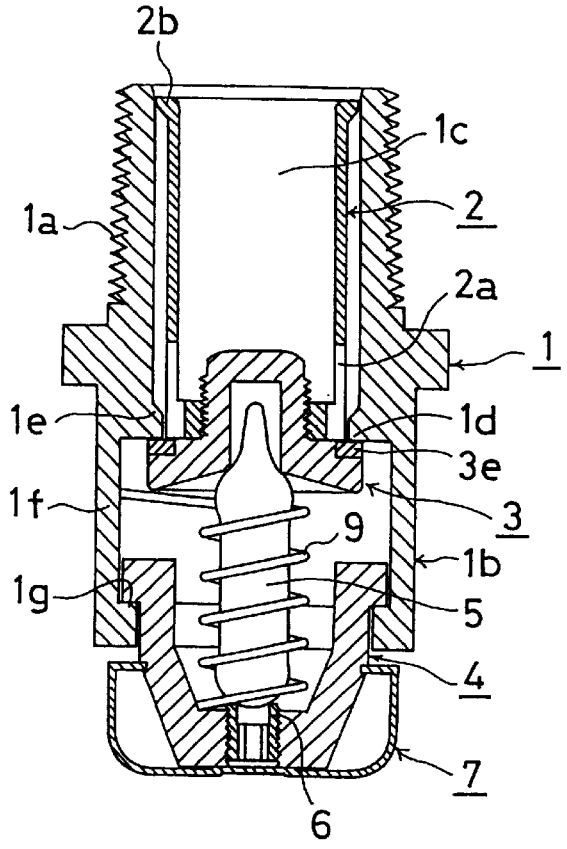
FIG. 13 is a schematic sectional view of the sprinkler head of the second embodiment.
Figure 14:
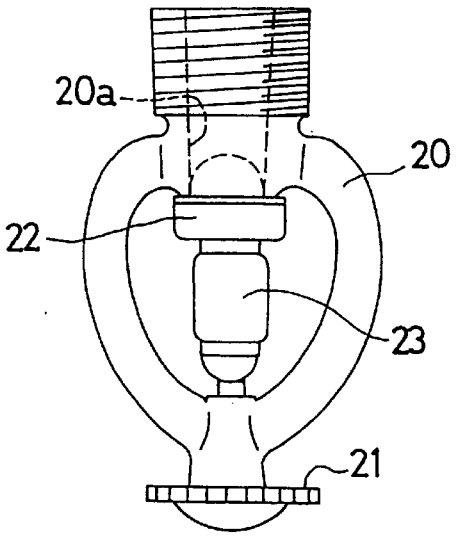
FIG. 14 is a schematic drawing of one conventional sprinkler head.
Figure 15:
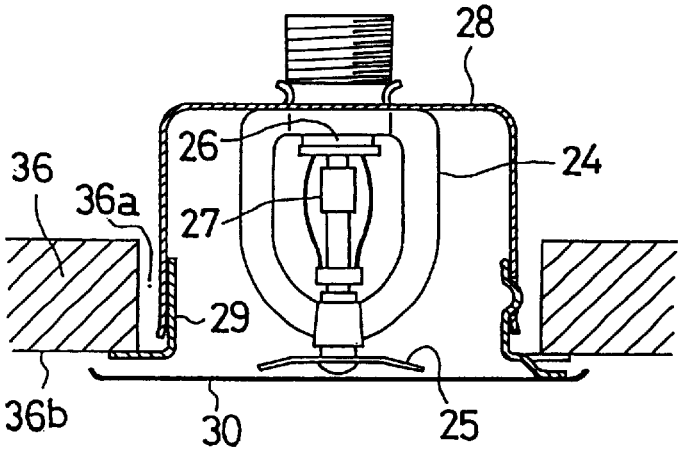
FIG. 15 is a sectional view of another conventional sprinkler head.
Figure 16:
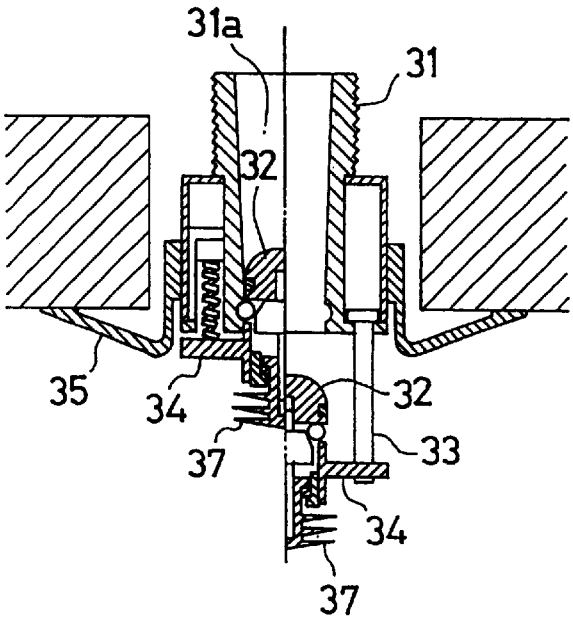
FIG. 16 is a sectional view of a further conventional sprinkler head.

FIG. 13 is a cross section drawing of a sprinkler head according to a second embodiment of the invention before it is deployed and is of the same section as the drawing of the first embodiment shown in FIG. 3. A coil spring 9 is positioned between the bottom of the cap 3 and the holder 4 in FIG. 13, and the holder 4 which connects to the lug 1*g* of the lower frame 1*b* will turn in the direction whereby the holder 4 separates from the body 1 by rotational force provided by the coil spring 9. In other words, as shown in FIG. 13, the coil spring 9 around the glass bulb 5 and the top of the coil spring 9 connects to the guide body 1*f* of the body 1, and the other end connects to the lower ring 4*b* (or connector arm 4*c*) of the holder 4. Due to the elasticity of the coil spring 9, there is constant turning force to release the holder 4 from the holding step 1*g*, but the holder 4 is held in place (as shown in FIG. 13) when the glass bulb 5 is intact because the force between the lug 1*g* and the convex surface 4*e*, and the turning force of the convex surface 4*e* is greater than the turning force of the coil spring 9.

The holder 4 as used in second embodiment is similar to the holder 4 which is used in the first embodiment except the inclined surface 4*f* of the drive block 4*d* is not necessary because once glass bulb 5 bursts the holder 4 turns by the coil spring's 9 elasticity force and releases the contact between the holding step 1*g* of the body 1 and the convex surface 4*e* of the holder 4. There is no need to use water pressure to turn the holder 4 as described in the first embodiment.

Following is the construction and function of the sprinkler head.

Firstly, during assembly, insert the head of the cap 3 into the nozzle 2 and its lower edge is then worked to reduce the diameter to produce a tight connection between the cap 3 and the nozzle 2. Secondly, install the nozzle 2, glass bulb 5 and holder 4 to the bottom of the mouth of the body 1 and with a small turn holder 4 makes the convex surface 4*e* connect to the lug 1*g* of the body 1. In the case of the second embodiment (FIG. 13), the nozzle 2, the glass bulb 5, the coil spring 9 and the holder 4 are inserted and the convex surface 4*e* is engaged to the lug 1*g* of the body 1 by just twisting the holder 4 a little against the elasticity of the coil spring 9 and the contact between the holder 4 and the body 1 is tightened by the pressure screw 6 to put pressure on the glass bulb 5. As described above, a cover 7 may be attached to the bottom of the holder 4 after fitting the sprinkler head to the distribution pipe. When the surrounding temperature of the glass bulb 5 becomes higher than the set temperature caused for example by fire, the glass bulb 5 bursts as a result of the expanding liquid. As a result the nozzle 2 and the cap 3 drop down under the pressure of the water and become open after the seal 3*e* separates from the valve seat 1*d*. Pressurised water from the liquid passage 1*c* will flow from the upper body 1*a* into the lower frame 1*b* and part of it impinges against the drive 4*d* of the holder 4. In the first embodiment, once pressurised water presses on the inclined surface 4*f* of the drive block 4*d*, it turns the drive block 4*d* (holder 4) in one direction. This separates the holder 4 from the body 1 and consequently the holder 4 drops from the body 1 drop off, at the same time the nozzle 2 drops to a lower position which is maintained as the outwardly flared nozzle retainer 2*b* engages the shoulder 1*e* of the body 1 as shown in FIG. 4. As shown in FIG. 4, once the nozzle 2 is positioned the discharge apertures 2*a* become lower than the ceiling 8 and this makes possible sprinkling of the water as required from the discharge aperture 2*a* without obstruction from the ceiling.

BENEFIT OBTAINED FROM INVENTION

The sprinkler head is very compact and provides a smooth, even sprinkle because the nozzle 2, cap 3, glass bulb 5 and holder 4 are inside the body 1 without any obstacles outside. This feature allows the sprinkler to be connected to a distribution pipe in the ceiling space in advance of construction of the ceiling which enables easy checking for leaks on the distribution pipe or the sprinkler head.

Secondly, because the nozzle 2 and the cap 3 emerges out from the body 1 during operation most of the sprinkler head can be concealed in the ceiling 8, when the sprinkler is not operating the space required in the ceiling to accommodate the sprinkler head is minimized due to its compact rounded shape. This feature provides an attractive design feature and protection against damage. During operation, the nozzle 2 drops from the body 1 and the water discharge aperture 2*a* position becomes lower than the ceiling which provides for a smooth sprinkle. In addition the sprinkler head is very simple and has fewer parts as compared to known sprinkler heads which leads to substantial production cost reduction.

What is claimed is:

1. A sprinkler head comprising:

a main body 1 having a tubular upper body 1*a* connected to a water distribution pipe in a ceiling 8 and a lower frame 1*b* extending downward from the upper body 1*a* wherein a shoulder 1*e* provided with a valve seat 1*d* at the lower, inner circumference of the upper body 1*a* is formed and a plurality of lugs 1*g* facing inward are formed at the lower, inner circumferential portion of the lower frame 1*b,* a nozzle 2 which is movable up and down inside the upper body 1*a*, has an outwardly flared nozzle retainer 2*b* at the upper end portion to be engaged with the shoulder 1*e* for prevention of the downward movement of the nozzle 2 and has a plurality of discharge apertures 2*a* at its lower portion, a cap 3 which is fixed air-tightly to the lower end of the nozzle 2 and has a packing 3*e* at the outer circumferential portion thereof to be rested on the valve seat 1*d* of the upper body 1*a,* a holder 4 which is supported by engagement with the lugs 1*g* of the lower frame 1*b*, has a pressure screw 6 at the center of its lower face and has inclined surfaces 4*f* at the upper portion thereof which water under pressure from the top is to hit such that the holder 4 is rotated by allowing water under pressure to hit the inclined surfaces 4*f* for disengagement of the holder 4 from the lugs 1*g* and allowing the holder 4 to drop off, and a glass bulb 5 which is situated vertically between the lower face of the cap 3 and the holder 4 and presses the cap 3 against the valve seat 1*d* by pressing force of the pressing screw 6.

2. A sprinkler head as claimed in claim 1, in which the upper body 1*a* and lower frame 1*b* are separate components connected by a screw.

3. A sprinkler head as claimed in claim 1 or claim 2, in which the lower frame 1*b* has three arms 1*f*.

4. A sprinkler head as claimed in claim 1, in which the cap 3 has a lower collar 3*c* on a main base 3*a* on which a seal 3*e* is situated.

5. A sprinkler head as claimed in claim 1, in which the holder 4 comprises an upper ring 4*a*, a lower ring 4*b* and three connector arms 4*c* which connect the upper ring 4*a* to the lower ring 4*b* and the holder 4 further has three drive blocks 4*d* each with a convex surface 4*e* and an inclined surface 4*f* located on upper ring 4*a*.

6. A sprinkler head comprising:

a main body 1 having a tubular upper body 1*a* connected to a water distribution pipe in a ceiling 8 and a lower frame 1*b* extending downward from the upper body 1*a* wherein a shoulder 1*e* provided with a valve seat 1*d* at the lower, inner circumference of the upper body 1*a* is formed and a plurality of lugs 1*g* facing inward are formed at the lower, inner circumferential portion of the lower frame 1*b,* a nozzle 2 which is movable up and down inside the upper body 1*a*, has an outwardly flared nozzle retainer 2*b* at the upper end portion to be engaged with the shoulder 1*e* for prevention of the downward movement of the nozzle 2 and has a plurality of discharge apertures 2*a* at its lower portion, a cap 3 which is fixed air-tightly to the lower end of the nozzle 2 and has a packing 3*e* at the outer circumferential portion thereof to be rested on the valve seat 1*d* of the upper body 1*a,* a holder 4 which is supported by engagement with the lugs 1*g* of the lower frame 1*b*, has a pressure screw 6 at the center of its lower face and is disengaged from the lugs 1*g* by rotating the holder 4 for allowing the holder 4 to drop off, a glass bulb 5 which is situated vertically between the lower face of the cap 3 and the holder 4 and presses the cap 3 against the valve seat 1*d* by pressing force of the pressing screw 6, and a coil spring 9 which wraps around the glass bulb 5 and connects at one end to the main body 1 and at the other end to the holder 4 and applies a turning force to release the holder 4 from lugs 1*a* wherein as the glass bulb 5 bursts the coil spring 9 causes the holder 4 to turn, thereby allowing the holder 4 to drop off.

7. A sprinkler head as claimed in claim 6, in which the body 1 comprises an upper body 1*a* and a lower frame 1*b* connected by a screw.

8. A sprinkler head as claimed in claim 6 or claim 7, in which the lower frame 1*b* has three arms 1*f*.

9. A sprinkler head as claimed in claim 6, in which the cap 3 has a lower collar 3*c* on a main base 3*a* on which a seal 3*e* is situated.

10. A sprinkler head as claimed in claim 6, in which the holder 4 comprises an upper ring 4*a*, a lower ring 4*b* and three connector arms 4*c* and the upper ring 4*a* has at its top three drive blocks 4*d* each provided with a convex surface 4*e*.

* * * * *